US006732052B2

(12) United States Patent
Macdonald et al.

(10) Patent No.: US 6,732,052 B2
(45) Date of Patent: May 4, 2004

(54) METHOD AND APPARATUS FOR PREDICTION CONTROL IN DRILLING DYNAMICS USING NEURAL NETWORKS

(75) Inventors: Robert P. Macdonald, Houston, TX (US); Volker Krueger, Celle (DE); Vladimir Dubinsky, Houston, TX (US); John D. MacPherson, Sugar Land, TX (US); Dmitriy Dashevskiy, Boye (DE)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/965,958

(22) Filed: Sep. 28, 2001

(65) Prior Publication Data

US 2002/0120401 A1 Aug. 29, 2002

Related U.S. Application Data

(60) Provisional application No. 60/236,581, filed on Sep. 29, 2000.

(51) Int. Cl.[7] ..... G01V 1/40; E21B 44/00

(52) U.S. Cl. ..... 702/6; 175/24

(58) Field of Search ..... 702/6; 703/5; 700/48; 175/24

(56) References Cited

U.S. PATENT DOCUMENTS

| | | | | |
|---|---|---|---|---|
| 4,739,841 A | | 4/1988 | Das | 175/61 |
| 5,812,068 A | * | 9/1998 | Wisler et al. | 340/855.5 |
| 5,947,213 A | | 9/1999 | Angle et al. | 175/24 |
| 6,012,015 A | * | 1/2000 | Tubel | 702/6 |
| 6,021,377 A | | 2/2000 | Dubinsky et al. | 702/9 |
| 6,026,911 A | | 2/2000 | Angle et al. | 175/24 |
| 6,206,108 B1 | * | 3/2001 | MacDonald et al. | 175/24 |
| 6,424,919 B1 | * | 7/2002 | Moran et al. | 702/6 |
| 6,446,718 B1 | * | 9/2002 | Barrett et al. | 166/250.01 |

FOREIGN PATENT DOCUMENTS

| | | |
|---|---|---|
| DE | 19941197 A1 | 9/1998 |
| EP | 0595033 A2 | 5/1994 |

(List continued on next page.)

OTHER PUBLICATIONS

"Application of Neural Networks for Predictive Control in Drilling Dynamics", Dashevskiy et al., SPE Annual Technical Conference, Oct. 3–6, 1999.*

(List continued on next page.)

*Primary Examiner*—John Barlow
*Assistant Examiner*—Toan M Le
(74) *Attorney, Agent, or Firm*—Madan, Mossman & Sriram, P.C.

(57) ABSTRACT

The present invention provides a drilling system that utilizes a neural network for predictive control of drilling operations. A downhole processor controls the operation of the various devices in a bottom hole assembly to effect changes to drilling parameters and drilling direction to autonomously optimize the drilling effectiveness. The neural network iteratively updates a prediction model of the drilling operations and provides recommendations for drilling corrections to a drilling operator.

25 Claims, 6 Drawing Sheets

FOREIGN PATENT DOCUMENTS

| | | | |
|---|---|---|---|
| EP | 0718641 | A2 | 6/1996 |
| EP | 1126129 | A1 | 8/2001 |
| GB | 2340944 | A | 3/2000 |
| GB | 2352046 | A | 1/2001 |
| JP | 6346448 | A | 12/1994 |
| WO | WO97/31175 | | 8/1997 |
| WO | WO00/50728 | | 8/2000 |
| WO | WO01/61140 | A1 | 8/2001 |
| WO | WO02/38915 | A2 | 5/2002 |

OTHER PUBLICATIONS

"An Engineering Simulator for Drilling: Part II", Millheim et al., SPE Annual Technical Conference, Oct. 6–8, 1983.*

"Downhole Diagnosis of drilling Dynamics Data Provides New Level Drilling Process Control to Driller", Heisig et al., SPE Annual technical Conference, Sep. 27–30, 1998.*

"Application of Neural Networks for Predictive Control in Drilling Dynamics", Dashevskiy et al., SPE Annual Technical Conference, Oct. 3–6, 1999.*

"An Engineering Simulator for Drilling: Part II", Millheim et al., SPE Annual Technical Conference, Oct. 6–8, 1983.*

"Downhole Diagnosis of drilling Dynamics Data Provides New Level Drilling Process Control to Driller", Heisig et al., SPE Annual technical Conference, Sep. 27–30, 1998.*

* cited by examiner

METHOD AND APPARATUS FOR PREDICTION CONTROL IN DRILLING DYNAMICS USING NEURAL NETWORKS

CROSS-REFERENCE TO RELATED APPLICATION

This application relates to U.S. Patent Application Serial No. 60/236,581 filed on Sep. 29, 2000, the entire specification of which is incorporated herein by reference.

BACKGROUND OF THE INVENTION

1. Field of the Invention

This invention relates generally to systems for drilling oilfield wellbores and more particularly to the use of a neural network to model dynamic behavior of a non-linear multi-input drilling system.

2. Description of the Related Art

Oilfield wellbores are formed by rotating a drill bit carried at an end of an assembly commonly referred to as the bottom hole assembly or "BHA." The BHA is conveyed into the wellbore by a drill pipe or coiled-tubing. The rotation of the drill bit is effected by rotating the drill pipe and/or by a mud motor depending upon the tubing used. For the purpose of this invention, BHA is used to mean a bottom hole assembly with or without the drill bit. Prior art bottom hole assemblies generally include one or more formation evaluation sensors, such as sensors for measuring the resistivity, porosity and density of the formation. Such bottom hole assemblies also include devices to determine the BHA inclination and azimuth, pressure sensors, temperature sensors, gamma ray devices, and devices that aid in orienting the drill bit a particular direction and to change the drilling direction. Acoustic and resistivity devices have been proposed for determining bed boundaries around and in some cases in front of the drill bit.

The operating or useful life of the drill bit, mud motor, bearing assembly, and other elements of the BHA depends upon the manner in which such devices are operated and the downhole conditions. This includes rock type, drilling conditions such as pressure, temperature, differential pressure across the mud motor, rotational speed, torque, vibration, drilling fluid flow rate, force on the drill bit or the weight-on-bit ("WOB"), type of the drilling fluid used and the condition of the radial and axial bearings.

Operators often tend to select the rotational speed of the drill bit and the WOB or the mechanical force on the drill bit that provides the greatest or near greatest rate of penetration ("ROP"), which over the long run may not be most cost effective method of drilling. Higher ROP can generally be obtained at higher WOB and higher rpm, which can reduce the operating life of the components of the BHA. If any of the essential BHA component fails or becomes relatively ineffective, the drilling operation must be shut down to pull out the drill string from the borehole to replace or repair such a component. Typically, the mud motor operating life at the most effective power output is less than those of the drill bits. Thus, if the motor is operated at such a power point, the motor may fail prior to the drill bit This will require stopping the drilling operation to retrieve and repair or replace the motor. Such premature failures can significantly increase the drilling cost. It is, thus, highly desirable to monitor critical parameters relating to the various components of the BHA and determine therefrom the desired operating conditions that will provide the most effective drilling operations or to determine dysfunctions that may result in a component failure or loss of drilling efficiency.

Physical and chemical properties of the drilling fluid near the drill bit can be significantly different from those at the surface. Currently, such properties are usually measured at the surface, which are then used to estimate the properties downhole. Fluid proerties, such as the viscosity, density, clarity, pH level, temperature and pressure profile can significantly affect the drilling efficiency. Downhole measured drilling fluid properties can provide useful information about the actual drilling conditions near the drill bit.

Recent advancements in the field of drilling dynamics occurred with the development and introduction to the industry of "smart" downhole vibration Measurement-While-Drilling (MWD) tools. These advanced MWD tools measure and interpret drillstring vibrations downhole and transmit condensed information to the driller in real time. The basic philosophy of this approach is to provide the driller with real-time information about the dynamic behavior of the BHA, so that the driller may make desired corrections. The time interval between determining a dysfunction and the corrective action was still significant.

A multi-sensor downhole MWD tool acquires and processes dynamic measurement, and generates diagnostic parameters, which quantify the vibration related drilled dysfunction. These diagnostics are then immediately transmitted to the surface via MWD telemetry. The transmitted information may be presented to the driller in a very simple form, (for example, as green-yellow-red traffic lights or color bars) using a display on the rig floor. Recommended corrective actions are presented alongside the transmitted diagnostics. Based on this information, and using his own experience, the driller can then modify the relevant control parameters (such as hook load, drill string RPM and mud flow rate) to avoid or resolve a drilling problem.

After modifying the control parameters, and after the next portion of downhole data is received at the surface, the driller observes the results of the corrective actions using the rig floor display. If necessary, the driller might again modify the surface controls. This process may tentatively continue until the desired drilling mode is achieved.

The commercial introduction of advanced MWD drilling dynamics tools, and the Closed-Loop vibration control concept, has resulted in the need for a more reliable method of generating the corrective advice that is presented to the driller. It is necessary to develop a reliable method of selecting the appropriate drilling control parameters to efficiently cure observed dynamic dysfunctions. This implies the development of a method to predict the dynamic behavior of the BHA under specific drilling condition.

Drilling dynamic simulators have been developed based on a pseudo-statistical approach. A system identification technique was used to implement this concept. This approach requires the acquisition of downhole and surface drilling dynamics data, along with values of the surface control parameters, over significant intervals of time. This information is then used to create a model that, to some degree, simulates the behavior of the real drilling system. Although this approach represented a significant step forward in predictive drilling dynamics modeling, it achieved only limited success, as it was appropriate only for the identification of linear systems. The behavior of a drilling system, however, can be significantly non-linear. Therefore other methods of modeling the dynamic behavior of the drilling system to achieve the necessary degree of predictive accuracy are desirable.

Real-time monitoring of BHA and drill bit dynamic behavior is a critical factor in improving drilling efficiency.

It allows the driller to avoid detrimental drillstring vibrations and maintain optimum drilling conditions through periodic adjustments to various surface control parameters (such as hook load, RPM, flow rate and mud properties). However, selection of the correct control parameters is not a trivial task. A few iterations in parameter modification may be required before the desired effect is achieved and, even then, further modification may be necessary. For this reason, the development of efficient methods to predict the dynamic behavior of the BHA and methods to select the appropriate control parameters is important for improving drilling efficiency.

The present invention addresses the above noted problems and provides a drilling apparatus that utilizes a Neural Network (NN) to monitor physical parameters relating to various elements in the drilling apparatus BHA including drill bit wear, temperature, mud motor rpm, torque, differential pressure across the mud motor, stator temperature, bearing assembly temperature, radial and axial displacement, oil level in the case of sealed-bearing-type bearing assemblies, and weight-on-bit (WOB).

SUMMARY OF THE INVENTION

The present invention provides an apparatus and method for automated drilling operations using predictive control. The apparatus includes a drill bit disposed on a distal end of a drillstring. A plurality of sensors are disposed in the drillstring for making measurements during the drilling of the wellbore relating to a parameter of interest. A processor is associated with the sensors to process the measurements for creating answers indicative of the measured parameter of interest, and a downhole analyzer including a neural network is operatively associated with the sensors and the processor for predicting behavior of the drillstring.

Sensors in the plurality of sensors are selected from drill bit sensors, sensors which provide parameters for a mud motor, BHA condition sensors, BHA position and direction sensors, borehole condition sensors, an rpm sensor, a weight on bit sensor, formation evaluation sensors, seismic sensors, sensors for determining boundary conditions, sensors which determine the physical properties of a fluid in the wellbore, and sensors that measure chemical properties of the wellbore fluid. These sensors, the analyzer neural network and processor cooperate to develop recommendations for future drilling parameter settings based in part on the measured parameters and in part on one or more what-if scenarios.

A method is provided that includes drilling a wellbore using a drill bit disposed on a distal end of a drillstring, making measurements during the drilling of the wellbore relating to a parameter of interest using a plurality of sensors disposed in the drillstring, and processing the measurements with a processor. Behavior of the drillstring is then predicted using a downhole analyzer that includes a neural network operatively associated with the sensors and the processor.

The method includes predicting future behavior based on measured parameters and one or more what-if scenarios. The predicted behavior is then used to develop recommendations for future drilling operation parameters. The recommendations may be implemented by operation interaction with an interface panel, or the recommendations may be implemented autonomously within the drilling tool.

The system of the present invention achieves drilling at enhanced drilling rates and with extended component life. The system utilizes a BHA having a plurality of sensors for measuring parameters of interest relating to the drilling operation. The measured parameters are analyzed using a neural network for predicting future behavior of the drilling system. Recommendations for changing one or more drilling parameters are provided via an interface panel and the driller may effect changes using the recommendations or the driller may allow the system to autonomously effect the changes.

Examples of the more important features of the invention thus have been summarized rather broadly in order that detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiments, taken in conjunction with the accompanying drawings, in which like elements have been given like numerals and wherein.

DESCRIPTION OF THE PREFERRED EMBODIMENTS

In general, the present invention provides a drilling system for drilling oilfield boreholes or wellbores. An important feature of this invention is the use of neural network algorithms and an integrated bottom hole assembly ("BHA") (also referred to herein as the drilling assembly) for use in drilling wellbores. A suitable tool, which may be adapted for use in the present invention, is described in U.S. Pat. No. 6,233,524 issued on May 15, 2001 and having a common assignee with the present invention, the entire contents of which are incorporated herein by reference. Another suitable tool having an integrated BHA, which may be adapted for use in the present invention is described in U.S. Pat. No. 6,206,108 issued on Mar. 27, 2001 and having a common assignee with the present invention, the entire contents of which are incorporated herein by reference.

As neural networks are not currently utilized in drilling systems, a brief discussion of the fundamentals is appropriate. Neural Network methodology is a modeling technique. In the present invention, this methodology is used to develop a real world on-line advisor for the driller in a closed loop drilling control system. The method provides the driller with a quantitative recommendation on how to modify key drilling control parameters. The following section examines certain theoretical aspects of the application of Neural Networks to predictive control of drilling dynamics.

Neural Networks: History and Fundamentals

The first conceptual elements of Neural Networks were introduced in the mid 1940's, and the concept developed gradually until the 1970's. However, the most significant steps in developing the more robust theoretical aspects of this new method were made during the last two decades. This coincided with the explosion in computer technology and the added attention focused on the use of artificial intelligence (AI) in various applications. Recently, additional interest has been generated in the application of neural networks ("NN") in control systems. Neural networks demonstrate many desirable properties required in situations with complex, nonlinear and uncertain control parameters. Some of these properties which make Neural Networks suitable for intelligent control applications, include learning by experience ("human-like" learning behavior); ability to generalize (map similar inputs to similar outputs); parallel distributed process for fast processing of large scale dynamic systems; robustness in the presence of noise; and multivariable capabilities.

Figure 1A:
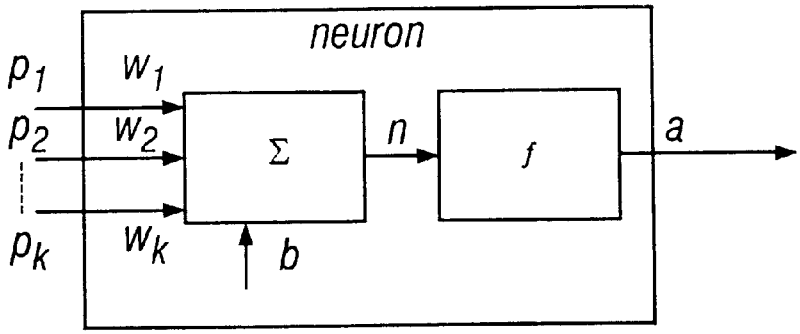
FIG. 1A is a functional diagram of typical neural network.
Figure 1B:
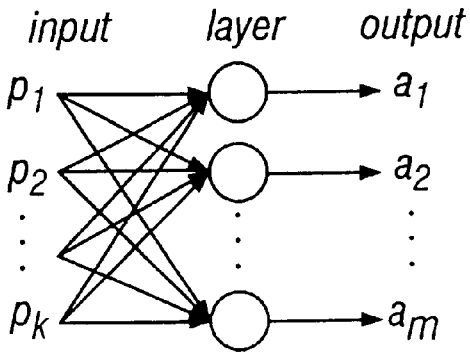
FIG. 1B shows a neural network having multiple layers.
Figure 1C:
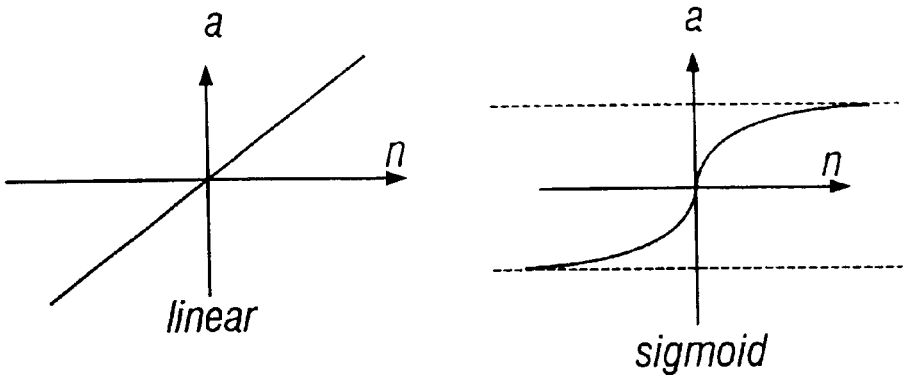
FIG. 1C shows two activation functions used in a neural network of FIGS. 1A and 1B.

The basic processing element of NN is often called a neuron. Each neuron has multiple inputs and a single output as shown in FIG. 1A. Each time a neuron is supplied with input vector $\overline{p}$ it computes its neuron output (a) by the formula:

$$a = f(\overline{w}^T \cdot \overline{p} + b) \tag{1}$$

where $f$ is a neuron activation function, $\overline{w}$ is a neuron weight vector, and b is a neuron bias. Some activation functions are presented in FIG. 1C. These functions, as shown, may be linear or sigmoid.

Two or more of the neurons described above may be combined in a layer as shown in FIG. 1B. A layer is not constrained to having the number of its inputs equal to the number of its neurons. A network can have several layers. Each layer has a weight matrix W, a bias vector b and an output vector a. The output from each intermediate layer is the input to the following layer. The layers in a multi-layer network play different roles. A layer that produces the network output is called an output layer. All other layers are called hidden layers. The network shown in FIG. 1B, for example, has one output layer and two hidden layers.

Training procedures may be applied once topology and activation functions are defined. In supervised learning a set of input data and correct output data (targets) are used to train the network. The network, using the set of training input, produces its own output. This output is compared with the targets and the differences are used to modify the weights and biases. Methods of deriving the changes that might be made in a network, or a procedure for modifying the weights and biases of a network, are called learning rules.

A test set, i.e. a set of inputs and targets that were not used in training the network, is used to verify the quality of the obtained NN. In other words, the test set is used to verify how well the NN can generalize. Generalization is an attribute of a network whose output for a new input vector tends to be close to the output generated for similar input vectors in its training set.

With this understanding of the neural network operation, a drilling apparatus according to the present invention will now be explained. The input vectors are determined in the apparatus of the present invention by using any number of known sensors located in the system. A BHA may include a number of sensors, downhole controllable devices, processing circuits and a neural network algorithm. The BHA carries the drill bit and is conveyed into the wellbore by a drill pipe or a coiled-tubing. The BHA utilizing the NN and/or information provided from the surface processes sensor measurements, tests and calibrates the BHA components, computes parameters of interest that relate to the condition or health of the BHA components, computes formation parameters, borehole parameters, parameters relating to the drilling fluid, bed boundary information, and in response thereto determines the desired drilling parameters. The BHA might also take actions downhole by automatically controlling or adjusting downhole controllable devices to optimize the drilling effectiveness.

Specifically, the BHA includes sensors for determining parameters relating to the physical condition or health of the various components of the BHA, such as the drill bit wear, differential pressure across the mud motor, degradation of the mud motor stator, oil leaks in the bearing assembly, pressure and temperature profiles of the BHA and the drilling fluid, vibration, axial and radial displacement of the bearing assembly, whirl, torque and other physical parameters. Such parameters are generally referred to herein as the "BHA parameters" or "BHA health parameters." Formation evaluation sensors included in the BHA provide characteristics of the formations surrounding the BHA. Such parameters include the formation resistivity, dielectric constant, formation porosity, formation density, formation permeability, formation acoustic velocity, rock composition, lithological characteristics of the formation and other formation related parameters. Such parameters are generally referred to herein as the "formation evaluation parameters." Any other sensor suitable for drilling operations is considered within the scope of the present invention.

Sensors for determining the physical and chemical properties (referred to as the "fluid parameters") of the drilling fluid disposed in the BHA provide in-situ measurements of the drilling fluid parameters. The fluid parameters sensors include sensors for determining the temperature and pressure profiles of the wellbore fluid, sensors for determining the viscosity, compressibility, density, chemical composition (gas, water, oil and methane contents, etc.). The BHA also contains sensors which determine the position, inclination and direction of the drill bit (collectively referred to herein as the "position" or "directional" parameters); sensors for determining the borehole condition, such as the borehole size, roughness and cracks (collectively referred to as the "borehole parameters"); sensors for determining the locations of the bed boundaries around and ahead of the BHA; and sensors for determining other geophysical parameters (collectively referred to as the "geophysical parameters"). The BHA also measures "drilling parameters" or "operations parameters," which include the drilling fluid flow rate, drill bit rotary speed, torque, and weight-on-bit or the thrust force on the bit ("WOB").

The BHA contains steering devices that can be activated downhole to alter the drilling direction. The BHA also may contain a thruster for applying mechanical force to the drill bit for drilling horizontal wellbores and a jet intensifier for aiding the drill bit in cutting rocks. The BHA preferably includes redundant sensors and devices which are activated when their corresponding primary sensors or devices becomes inoperative.

The neural network algorithms are stored in the BHA memory. The NN dynamic model is updated during the drilling operations based on information obtained during such drilling operations. Such updated models are then utilized to further drill the borehole. The BHA contains a processor that processes the measurements from the various sensors, communicates with surface computers, and utilizing the NN determines which devices or sensors to operate at any given time. It also computes the optimum combination of the drilling parameters, the desired drilling path or direction, the remaining operating life of certain components of the BHA, the physical and chemical condition of the drilling fluid downhole, and the formation parameters. The downhole processor computes the required answers and, due to the limited telemetry capability, transmits to the surface only selected information. The information that is needed for later use is stored in the BHA memory. The BHA takes the actions that can be taken downhole. It alters the drilling direction by appropriately operating the direction control devices, adjusts fluid flow through the mud motor to operate it at the determined rotational speed and sends signals to the surface computer, which adjusts the drilling parameters. Additionally, the downhole processor and the surface computer cooperate with each other to manipulate the various types of data utilizing the NN, take actions to achieve in a closed-loop manner more effective drilling of the wellbore, and providing information that is useful for drilling other wellbores.

Dysfunctions relating to the BHA, the current operating parameters and other downhole-computed operating parameters are provided to the drilling operator, preferably in the form of a display on a screen. The system may be programmed to automatically adjust one or more of the drilling parameters to the desired or computed parameters for continued operations. The system may also be programmed so that the operator can override the automatic adjustments and manually adjust the drilling parameters within predefined limits for such parameters. For safety and other reasons, the system is preferably programmed to provide visual and/or audio alarms and/or to shut down the drilling operation if certain predefined conditions exist during the drilling operations. The preferred embodiments of the integrated BHA of the present invention and the operation of the drilling system utilizing such a BHA are described below.

Figure 2:
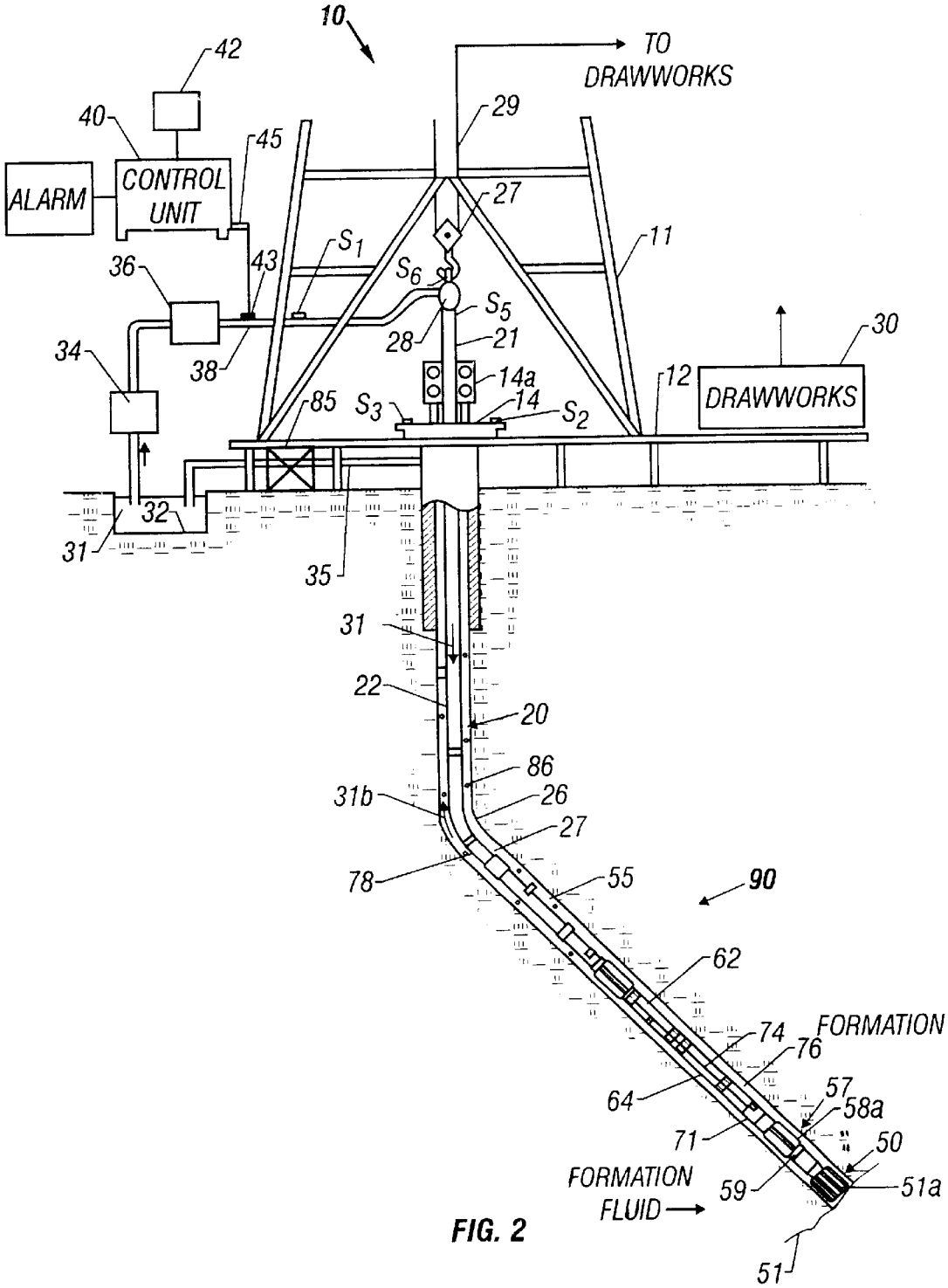
FIG. 2 is a schematic diagram of a drilling system with an integrated bottom hole assembly according to a preferred embodiment of the present invention.

FIG. 2 shows a schematic diagram of a drilling system 10 having a bottom hole assembly (BHA) or drilling assembly 90 shown conveyed in a borehole 26. The drilling system 10 includes a conventional derrick 11 erected on a floor 12 which supports a rotary table 14 that is rotated by a prime mover such as an electric motor (not shown) at a desired rotational speed. The drill string 20 includes a tubing (drill pipe or coiled-tubing) 22 extending downward from the surface into the borehole 26. A tubing injector 14*a* is used to inject the BHA into the wellbore when a coiled-tubing is used as the conveying member 22. A drill bit 50, attached to the drill string 20 end, disintegrates the geological formations when it is rotated to drill the borehole 26. The drill string 20 is coupled to a drawworks 30 via a kelly joint 21, swivel 28 and line 29 through a pulley 27. Drawworks 30 is operated to control the weight on bit ("WOB"), which is an important parameter that affects the rate of penetration ("ROP"). The operations of the drawworks 30 and the tubing injector are known in the art and are thus not described in detail herein.

During drilling, a suitable drilling fluid 31 from a mud pit (source) 32 is circulated under pressure through the drill string 20 by a mud pump 34. The drilling fluid passes from the mud pump 34 into the drill string 20 via a desurger 36 and a fluid line 38. The drilling fluid 31 discharges at the borehole bottom 51 through openings in the drill bit 50. The drilling fluid 31 circulates uphole through the annular space 27 between the drill string 20 and the borehole 26 and returns to the mud pit 32 via a return line 35 and drill cuttings screen 85 that removes drill cuttings 86 from the returning drilling fluid 31*b*. A sensor S1 in line 38 provides information about the fluid flow rate. A surface torque sensor S2 and a sensor S3 associated with the drill string 20 respectively provide information about the torque and the rotational speed of the drill string 20. Tubing injection speed is determined from the sensor S5, while the sensor S6 provides the hook load of the drill string 20.

In some applications, the drill bit 50 is rotated by only rotating the drill pipe 22. However, in many other applications, a downhole motor 55 (mud motor) is disposed in the drilling assembly 90 to rotate the drill bit 50 and the drill pipe 22 is rotated usually to supplement the rotational power, if required, and to effect changes in the drilling direction. In either case, the ROP for a given BHA largely depends upon the WOB or the thrust force on the drill bit 50 and its rotational speed.

The mud motor 55 is coupled to the drill bit 50 via a drive shaft (not shown) disposed in a bearing assembly 57. The mud motor 55 rotates the drill bit 50 when the drilling fluid 31 passes through the mud motor 55 under pressure. The bearing assembly 57 supports the radial and axial forces of the drill bit 50, the downthrust of the mud motor 55 and the reactive upward loading from the applied weight on bit. A lower stabilizer 58*a* coupled to the bearing assembly 57 acts as a centralizer for the lowermost portion of the drill string 20.

A surface control unit or processor 40 receives signals from the downhole sensors and devices via a sensor 43 placed in the fluid line 38 and signals from sensors S1–S6 and other sensors used in the system 10 and processes such signals according to programmed instructions provided to the surface control unit 40. The surface control unit 40 displays desired drilling parameters and other information on a display/monitor 42 that is utilized by an operator to control the drilling operations. The surface control unit 40 contains a computer, memory for storing data, recorder for recording data and other peripherals.

The BHA 90 preferably contains a downhole-dynamic-measurement device or "DDM" 59 that contains sensors which make measurements relating to the BHA parameters. Such parameters include bit bounce, stick-slip of the BHA, backward rotation, torque, shocks, BHA whirl, BHA buckling, borehole and annulus pressure anomalies and excessive acceleration or stress, and may include other parameters such as BHA and drill bit side forces, and drill motor and drill bit conditions and efficiencies. The DDM 59 sensor signals are processed to determine the relative value or severity of each such parameter as a parameter of interest, which are utilized by the BHA and/or the surface computer 40. The DDM sensors may be placed in a subassembly or placed individually at any suitable location in the BHA 90. Drill bit 50 may contain sensors 51*a* for determining the drill bit condition and wear.

The BHA also contains formation evaluation sensors or devices for determining resistivity, density and porosity of the formations surrounding the BHA. A gamma ray device for measuring the gamma ray intensity and other nuclear an non-nuclear devices used as measurement-while-drilling devices are suitably included in the BHA 90. As an example, FIG. 1 shows a resistivity measuring device 64 coupled above a lower kick-off subassembly 62. It provides signals from which resistivity of the formation near or in front of the drill bit 50 is determined.

An inclinometer 74 and a gamma ray device 76 are suitably placed along the resistivity measuring device 64 for respectively determining the inclination of the portion of the drill string near the drill bit 50 and the formation gamma ray intensity. Any suitable inclinometer and gamma ray device, however, may be utilized for the purposes of this invention. In addition, position sensors, such as accelerometers, magnetometers or a gyroscopic devices may be disposed in the BHA to determine the drill string azimuth, true coordinates and direction in the wellbore 26. Such devices are known in the art and therefore are not described in detail herein.

In the above-described configuration, the mud motor 55 transfers power to the drill bit 50 via one or more hollow shafts that run through the resistivity measuring device 64. The hollow shaft enables the drilling fluid to pass from the mud motor 55 to the drill bit 50. In an alternate embodiment of the drill string 20, the mud motor 55 may be coupled below resistivity measuring device 64 or at any other suitable place. The above described resistivity device, gamma ray device and the inclinometer are preferably placed in a common housing that may be coupled to the motor. The devices for measuring formation porosity, permeability and density (collectively designated by numeral 78) are preferably placed above the mud motor 55. Such devices are known in the art and are thus not described in any detail.

As noted earlier, a large number of the current drilling systems, especially for drilling highly deviated and horizontal wellbores, utilize coiled-tubing for conveying the drilling assembly downhole. In such application a thruster 71 is deployed in the drill string 90 to provide the required force on the drill bit. For the purpose of this invention, the term weight on bit is used to denote the force on the bit applied to the drill bit during the drilling operation, whether applied by adjusting the weight of the drill string or by thrusters. Also, when coiled-tubing is utilized the tubing is not rotated by a rotary table, instead it is injected into the wellbore by a suitable injector 14*a* while the downhole motor 55 rotates the drill bit 50.

A number of sensors are also placed in the various individual devices in the drilling assembly. For example, a variety of sensors are placed in the mud motor power section, bearing assembly, drill shaft, tubing and drill bit to determine the condition of such elements during drilling and to determine the borehole parameters.

The bottom hole assembly 90 also contains devices which may be activated downhole as a function of the downhole computed parameters of interest alone or in combination with surface transmitted signals to adjust the drilling direction without retrieving the drill string from the borehole, as is commonly done in the prior art. This is achieved in the present invention by utilizing downhole adjustable devices, such as the stabilizers and kick-off assembly, which are well known.

The description thus far has related to specific examples of the sensors and their placement in the drillstring and BHA, and certain preferred modes of operation of the drilling system. This system results in forming wellbores at enhanced drilling rates (rate of penetration) with increased life of drilling components such as the BHA assembly. It should be noted that, in some cases, a wellbore can be drilled in a shorter time period by drilling certain portions of the wellbore at relatively slower ROP's because drilling at such ROP's prevents excessive BHA failures, such as motor wear, drill bit wear, sensor failures, thereby allowing greater drilling time between retrievals of the BHA from the wellbore for repairs or replacements. The overall configuration of the integrated BHA of the present invention and the operation of the drilling system containing such a BHA is described below.

Description of Controlled Dynamic System

Figure 3:
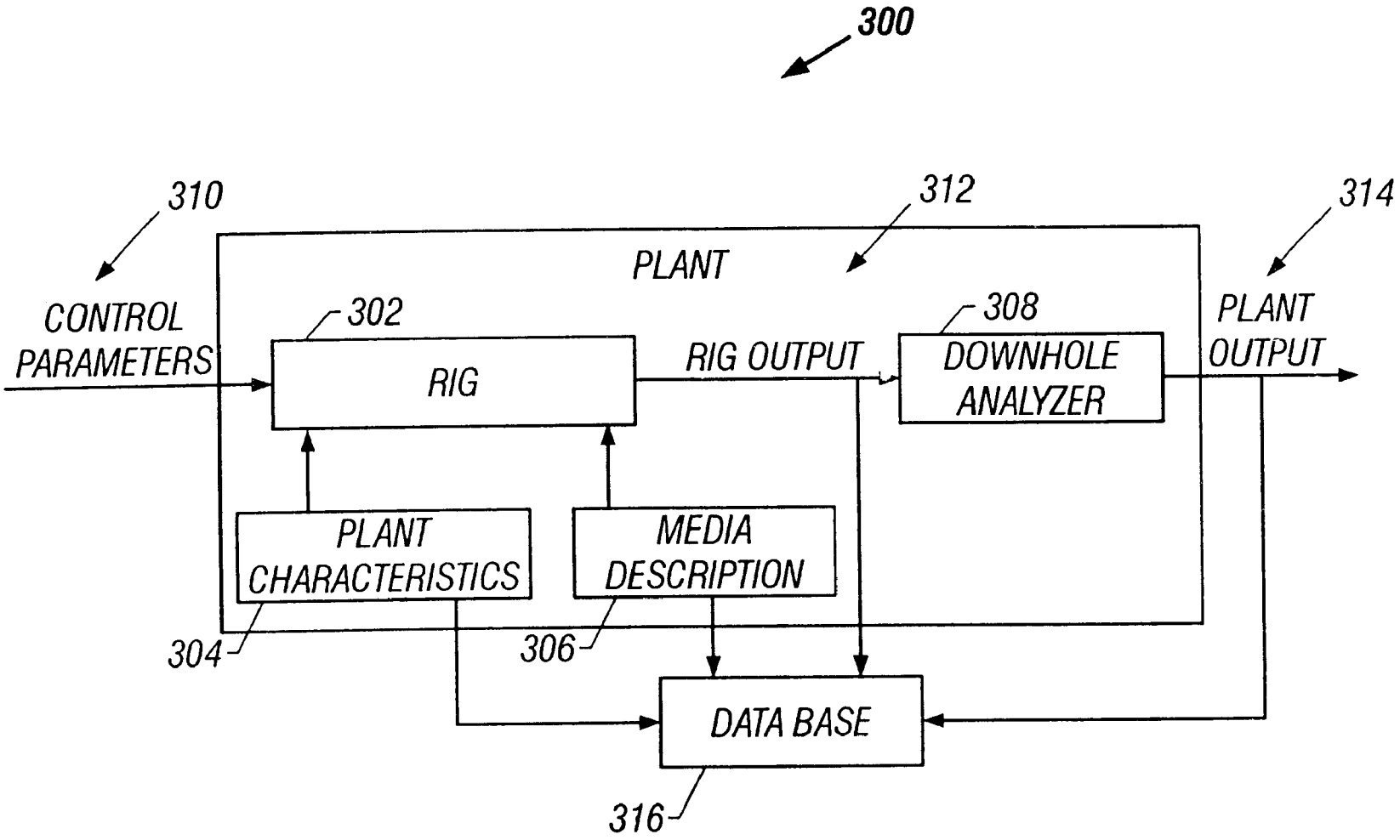
FIG. 3 is a block diagram of a drilling system according to the present invention represented as a plant flow chart.

The drilling system 10 as described above and shown in FIG. 2 is shown in FIG. 3 as a functional flow chart for illustrative purposes. FIG. 3 illustrates the application of neural network methodology according to the present invention to simulate and control the dynamic behavior of a drilling system or plant 300. The plant 300 is a combination of drilling components such as the rig 302, plant characteristics 304, media description 306, and a downhole analyzer 308. All surface and downhole equipment are represented as the rig 302, and the method includes consideration of parameters, which influence the performance of the rig 302. Control parameters 310 include all the parameters the driller can control interactively to affect rig output 312. Such parameters include, but are not limited to, hook load (HL) used by the driller to control downhole Weight-on-Bit (WOB), rotary speed i.e. surface RPM, mud flow rate, and mud properties e.g. mud density and viscosity. Plant characteristics 304 are the parameters related directly to the drilling equipment. These are predefined and their values are preferably not dynamically modified. Plant characteristics 304 include geometrical and mechanical parameters of the BHA, characteristics of the drill bit and downhole motor (if used), and other technical parameters of the drilling rig and its components. Media description 306 are those parameters which clearly affect rig performance but whose values are either unknown or only known to a certain degree while drilling. Media parameters include formation lithology, mechanical properties of the formation, wellbore geometry and well profile. Rig output 312 defines those parameters to be controlled. Examples include rate of penetration (ROP), drillstring and BHA vibration (for example, the lateral, torsional and axial components of vibration), downhole WOB, downhole RPM. ROP is the measurement of on-bottom drilling progress. Downhole vibrations are one of the main causes of drilling problems. Weight-on bit and rotating speed must be controlled due to the technical specifications and limitations of the drilling equipment.

The values of some of these parameters are available in real time at the surface (for example, ROP). The sensors described above are used to obtain the values of other parameters. A downhole analyzer 308 is used to process sensor output data to determine characteristics such as downhole vibration measurements in a timely manner. The downhole analyzer 308 both identifies each of a variety of drilling phenomena and quantifies a severity for each phenomenon. This allows for significantly reducing the volume of data sent to the surface, and provides the driller with condensed information about the most critical downhole dynamic dysfunctions (for example, bit bounce, BHA whirl, bending, and stick-slip). The outputs 314 of the analyzer 308 are conveyed to a database 316 and to the driller at the surface.

There are any number of known NN models in terms of varieties of topologies, activation functions and learning rules useful in the present invention. In a preferred embodiment, a Multilayer Feedforward Neural Network (MFNN) is used, because the MFNN has several desirable properties. The MFNN possesses two layers, where a hidden layer is sigmoid and an output layer is linear (see FIG. 1C), and can be trained to approximately any function (with a finite number of discontinuities) for a given well.

Figure 4:
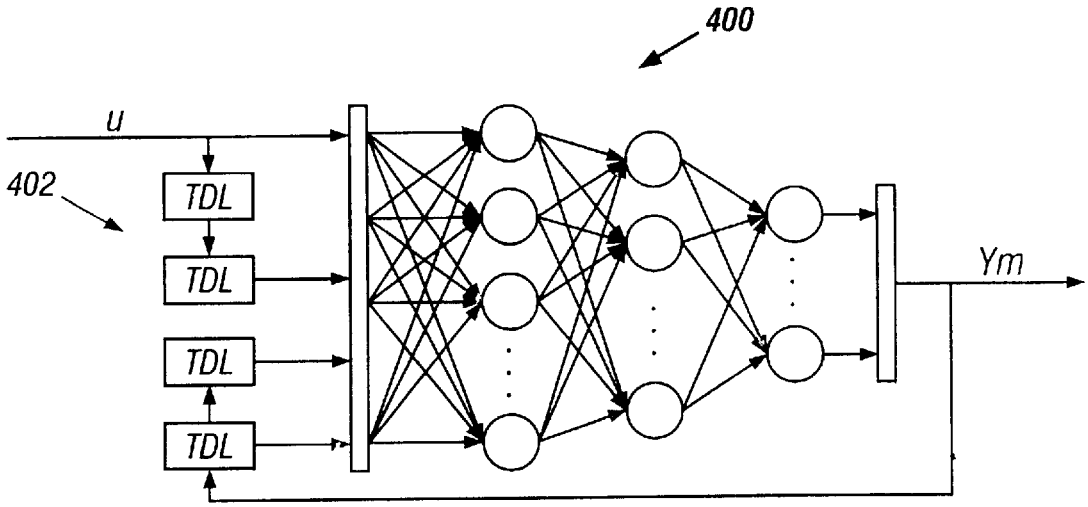
FIG. 4 is a diagram of a multi-layer neural network used for simulating a dynamic system.

The MFNN is a static mapping model, and theoretically it is not feasible to control or identify the dynamic system. However, it can be extended to the dynamic domain 400 as shown in see FIG. 4. In this case a time series of past real plant input u and output values $y_m$ are used as inputs to the MFNN with the help of tapped delay lines (TDL) 402.

One of the problems that occur during neural network training is called overfitting. The error on the training set is driven to a very small value, but when new data is presented to the network the error is large. The network has memorized the training examples, but it has not learned to generalize to a new situation. To avoid this problem Bayesian regularization, in combination with Levenberg-Marquardt training, are used. Both methods are known in the art.

In a preferred embodiment, inputs and targets are normalized to the range [−1,1]. It is known that NN training can be carried out more efficiently if certain preprocessing steps such as normalizing are performed with the network inputs and targets.

Preferred parameters used in building the NN model included hook load (converted to calculated WOB), RPM and flow rate (measured at the surface) and the levels of severity of dynamic dysfunctions, which are recorded downhole. In order to predict the state of the system at the next 20 second step (that is, at step "k+1") the NN model uses data values at the current step—WOB(k), RPM(k), Flow Rate(k), and Dysfunction(k)—along with the new key control parameters: WOB(k+1), RPM(k+1), and Flow Rate(k+1).

Increasing System Performance

Figure 5:
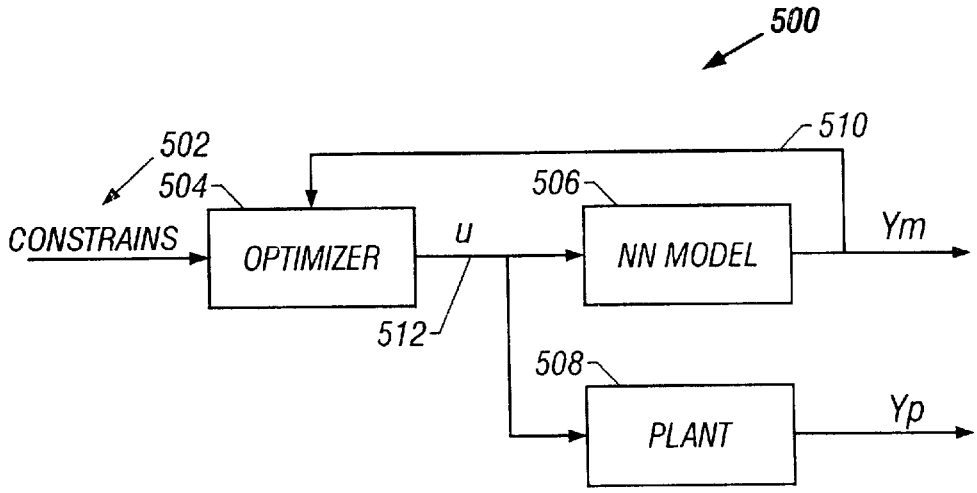
FIG. 5 is a flow diagram of a method of predictive control according to the present invention.

Referring now to FIG. 5, an alternative apparatus and method of use according to the present invention increases drilling efficiency using drilling dynamics criteria and an optimizer. Once the Neural Network model simulating the behavior of the plant is created and properly trained, predictive control is introduced. At this point the output is split from the plant into two categories $y_p$ and $y_m$. ROP can be considered as the main parameter $y_p$ of the optimization subject to constraints 502 on the dynamic dysfunctions. The method of the present invention is used to maximize a cost function F subject to G(dysfunctions)<0 using the formula:

$$F = \sum_{i=N_1}^{N_2} ROP(k+i) \tag{2}$$

where F is the cost function, $N_1$ is the minimum output prediction horizon, $N_2$ is the maximum output prediction horizon, and G represents the constraints 502.

FIG. 5 shows the predictive control flow 500. Constraints 502 are entered into an optimizer 504. The optimizer 504 has an output 512 that feeds into a NN model 506 and into a plant 508. The NN 506 and plant 508 are substantially similar to those like items described above and shown in FIGS. 3 and 4. An output 510 of the NN model is coupled to the optimizer 504 as an input in a feedback relationship. An iterative feedback process is used to provide predictive control of the plant 508 for stabilizing both linear and non-linear systems.

The general predictive control method includes predicting the plant output over a range of future time events, choosing a set of future controls {u} 512, which optimize the future plant performance $y_p$, and using the first element of {U} as a current input and iteratively repeating the process.

In one embodiment, a stand-alone computer application is utilized to build and train a NN model, which simulates the behavior of a system represented by a particular data set. The application is used to run various "what if" scenarios in manual mode to predict the response of the system to changes in the basic control parameters. The application may be used to automatically modify (in automated control mode) values of the control parameters to efficiently bring the system to the optimum drilling mode, in terms of maximizing ROP while minimizing drilling dysfunctions under the given parameter constraints.

Another aspect of the present invention is the use of a NN simulator as a closed-loop drilling control using drilling dynamics measurements. This method generates quantitative advice for the driller on how to change the surface controls when downhole drilling dysfunctions are detected and communicated to the surface using an MWD tool.

Description of User Interface

Figure 6A:
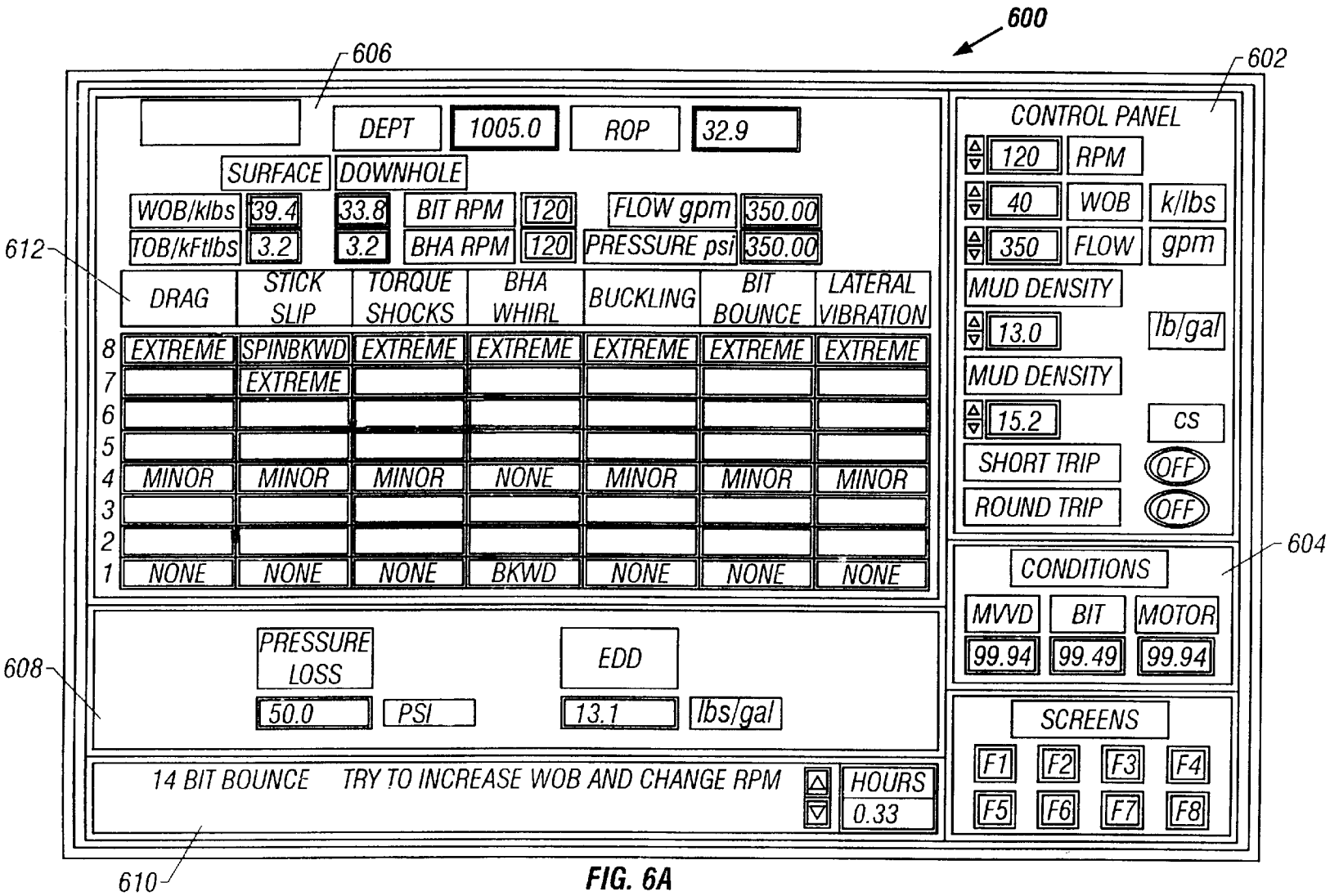
FIGS. 6A–B show alternative embodiments of a user interface device according to the present invention.
Figure 6B:
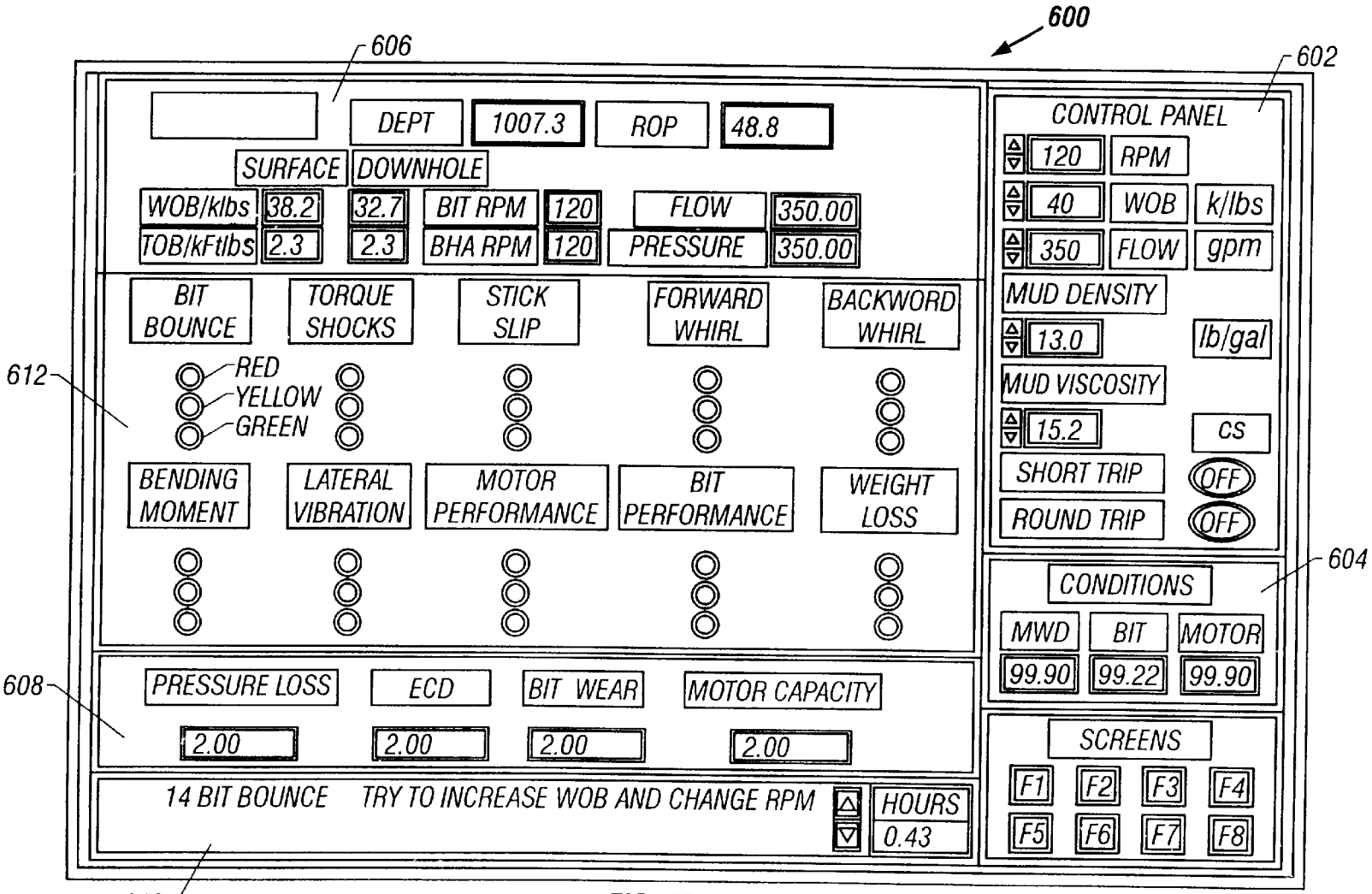

A preferred embodiment of the present invention includes a user interface 600 that is simple and intuitive for the end used. An example of such an interface is shown in FIGS. 6A and 6B. The display formats shown are exemplary, and any desired display format may be utilized for the purpose displaying dysfunctions and any other desired information. The downhole computed parameters of interest for which the severity level is to be displayed contain multiple levels using digital indicators 612. FIG. 6A shows such parameters as being the drag, bit bounce, stick slip, torque shocks, BHA whirl, buckling and lateral vibration, each such parameter having eight levels marked 1–8. It should be noted that the present system is neither limited to nor requires using the above-noted parameters or any specific number of levels. The downhole computed parameters RPM, WOB, FLOW (drilling fluid flow rate) mud density and viscosity are shown displayed under the header "CONTROL PANEL" in block 602. The relative condition of the MWD, mud motor and the drill bit on a scale of 0–100%, 100% being the condition when such element is new, is displayed under the header "CONDITION" in block 604. Certain surface measured parameters, such as the WOB, torque on bit (TOB), drill bit depth and the drilling rate or the rate of penetration are displayed in block 606. Additional parameters of interest, such as the surface drilling fluid pressure, pressure loss due to friction are shown displayed in block 608. A recommended corrective action developed by the neural network is displayed in block 610.

FIG. 6B shows an alternative display format for use in the present system. The difference between this display and the display shown in FIG. 6A is that downhole computed parameter of interest that relates to the dysfunction contains three colors, green to indicate that the parameter is within a desired range, yellow to indicate that the dysfunction is present but is not severe, much like a warning signal, and red to indicate that the dysfunction is severe and should be corrected. As noted earlier, any other suitable display format may be devised for use in the present invention.

FIGS. 6A–B show an operating screen 600 designed in the form of a front panel of an electronic device with relatively few controls and digital indicators. Interaction with the device is achieved using, for example, a mouse, a keyboard or a touch-sensitive screen. These devices are well known and thus not shown separately.

Sliding bars are used for setting the values of different parameters at the control panel 602 and for providing information about their valid ranges. The sliding bars also allow the user to visually estimate the relative position of a selected value within the permissible range of a parameter. The digital indicators 612 relating to the dynamic dysfunctions also serve as indicators of severity levels. They change their colors (using "green-yellow-red" pattern) as the lever of severity changes.

To operate the simulator the user has to specify the current state of the plant by setting the values of the control parameters (controls) and the observed plant output (response). Once the system state is specified, the simulator can make an estimate of the plant output for any new control settings entered by the user. To simplify the process of selecting new controls, 3-D plots (not shown) may be used as an output for any of the outputs from the plant as a function of any two control parameters. The plots representing dynamic dysfunctions show the value of the dysfunction colored according to severity. Color may be used in an ROP plot to represent the combined severity of all dynamic dysfunctions at each point.

The user may also decide whether to enter new control settings manually or to engage an automated optimization module (see 504 in FIG. 5). This module simply plays different "what if" scenarios showing the development of the plant over one minute intervals each comprising three time steps. The time interval may be adjusted as any particular application might require. The optimization module 504 automatically selects new controls to maximize ROP while keeping the dynamic dysfunctions in acceptable limits or "green" zones.

Time domain charts, showing the evolution of the selected parameters overtime may be used to help the user understand how an observed dynamic problem developed.

In cases of a severe whirl dysfunction, e.g. a level 6 out of a possible 8, combined with a moderate bending dysfunction e.g. a level 4 out of 8, the present methods allow for correction and plant stabilization in approximately 15 to 20 time steps, that is 5–6 minutes with each time step equal to 20 seconds. Reducing the dynamic dysfunctions in this manner can increase the ROP significantly.

In the case of a severe stick-slip dysfunction, the NN simulator might "recommend" (1) increasing RPM while decreasing WOB and (2) bringing the values of the control parameters to new levels different from the original state.

The method and apparatus of the present invention uses the power of Neural Networks (NN) to model dynamic behavior of a non-linear, multi-input/output drilling system. Such a model, along with a controller, provides the driller with a quantified recommendation on the appropriate correction action(s) to provide improved efficiency in the drilling operations.

The NN model is developed using drilling dynamics data from a field test. This field test involves various drilling scenarios in different lithologic units. The training and fine-tuning of the basic model utilizes both surface and downhole dynamics data recorded in real-time while drilling. Measurement of the dynamic state of the BHA is achieved using data from downhole vibration sensors. This information, which represents the effects of modifying surface control parameters, is recorded in the memory of the downhole tool. Representative portions of this test data set, along with the corresponding set of input-output control parameters, are used in developing and training the model.

The present invention provides simulation and prediction of the dynamic behavior of a complex multi-parameter drilling system. In addition, the present invention provides an alternative to traditional analytic or direct numerical modeling and its utilization is extended beyond drilling dynamics to the field of drilling control and optimization.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

What is claimed:

1. An apparatus for use in drilling an oilfield wellbore, comprising:

(a) a drill disposed on a distal end of a drillstring;

(b) a plurality of sensors disposed in the drillstring, each said sensor making measurements during the drilling of the wellbore relating to a parameter of interest;

(c) a processor adapted to process the measurements for creating answers indicative of the measured parameter of interest; and (d) a downhole analyzer including a neural network operatively associated with the sensors and the processor for predicting behavior of the drillstring.

2. The apparatus of claim 1, wherein the neural network is a multi-layer neural network.

3. The apparatus of claim 1, wherein the drill string includes a BHA, the drill bit and at least one of the plurality of sensors being disposed in the BHA.

4. The apparatus of claim 3, wherein the sensors in the plurality of sensors are selected from a group consisting of (a) drill bit sensors, (b) sensors which provide parameters for a mud motor, (c) BHA condition sensors, (d) BHA position and direction sensors, (e) borehole condition sensors, (f) an rpm sensor, (g) a weight on bit sensor, (h) formation evaluation sensors, (i) seismic sensors, (j) sensors for determining boundary conditions, (k) sensors which determine the physical properties of a fluid in the wellbore, and (l) sensors that measure chemical properties of the wellbore fluid.

5. The apparatus of claim 1 further comprising a downhole controlled steering device.

6. The apparatus of claim 1, wherein the neural network updates at least one internal model during the drilling of the wellbore based in part on the downhole computed answers and in part on one or more what-if scenarios.

7. The apparatus of claim 1, wherein the parameter of interest is a dysfunction associated with one or more drilling conditions.

8. The apparatus of claim 1 further comprising a surface interface panel operatively associated with the neural network for providing recommendations relating to future drilling parameters to a drilling operator.

9. The apparatus of claim 8, wherein the analyzer, processor and sensors cooperate to autonomously effect a change in the drilling parameters, the change in drilling parameters being substantially consistent with the recommendations.

10. A drilling system for drilling an oilfield wellbore, comprising:

(a) a drill string having a BHA, the BHA including;

(i) a drill bit at an end of the BHA;

(ii) a plurality of sensors disposed in the BHA, each said sensor making measurements during the drilling of the wellbore relating to one or more parameters of interest; and (iii) a processor in the BHA, said processor utilizing the plurality of models to manipulate the measurements from the plurality of sensors to determine answers relating to the measured parameters of interest downhole during the drilling of the wellbore;

(b) a downhole analyzer including a neural network operatively associated with the sensors and the processor for predicting behavior of the drillstring;

(c) a transmitter associated with the BHA for transmitting data to the surface; and (d) an interface panel, said interface panel for receiving said data from the BHA and in response thereto providing recommendations for adjusting at least one drilling parameter at the surface to a drilling operator.

11. The system of claim 10, wherein the neural network is a multi-layer neural network.

12. The system of claim 10, wherein the sensors in the plurality of sensors are selected from a group consisting of (a) drill bit sensors, (b) sensors which provide parameters for a mud motor, (c) BHA condition sensors, (d) BHA position and direction sensors, (e) borehole condition sensors, (f) an rpm sensor, (g) a weight on bit sensor, (h) formation evaluation sensors, (i) seismic sensors, (j) sensors for determining boundary conditions, (k) sensors which determine the physical properties of a fluid in the wellbore, and (l) sensors that measure chemical properties of the wellbore fluid.

13. The system of claim 10 further comprising a downhole controlled steering device.

14. The system of claim 10, wherein the neural network updates at least one internal model during the drilling of the wellbore based in part on the downhole computed answers and in part on one or more what-if scenarios.

15. The system of claim 10, wherein the parameter of interest is a dysfunction associated with one or more drilling conditions.

16. The system of claim 10, wherein the analyzer, processor and sensors cooperate to autonomously effect a change in the drilling parameters, the change in drilling parameters being substantially consistent with the recommendations.

17. A method of drilling an oilfield wellbore using predictive control, comprising:

(a) drilling a wellbore using a drill bit disposed on a distal end of a drillstring;

(b) making measurements during the drilling of the wellbore relating to one or more parameters of interest using a plurality of sensors disposed in the drillstring;

(c) processing the measurements with processor; and (d) predicting behavior of the drillstring using a downhole analyzer including a neural network operatively associated with the sensors and the processor.

18. The method of claim 17, wherein the neural network is a multi-layer neural network.

19. The method of claim 17, wherein at least one measured parameter of interest is a dysfunction associated with one or more drilling conditions.

20. The method of claim 17 further comprising providing recommendations relating to future drilling parameters to a drilling operator via a surface interface panel operatively associated with the neural network.

21. The method of claim 17 further comprising allowing the analyzer, processor and sensors to operate in cooperation to autonomously effect a change in the drilling parameters, the change in drilling parameters being substantially consistent with recommendations developed by the neural network.

22. The method of claim 17, wherein the drill string includes a BHA, the drill bit and at least one of the plurality of sensors being disposed in the BHA.

23. The method of claim 17, wherein the measurements are selected from a group consisting of (a) drill bit sensors, (b) sensors which provide parameters for a mud motor, (c) BHA condition sensors, (d) BHA position and direction sensors, (e) borehole condition sensors, (f) an rpm sensor, (g) a weight on bit sensor, (h) formation evaluation sensors, (i) seismic sensors, (j) sensors for determining boundary conditions, (k) sensors which determine the physical properties of a fluid in the wellbore, and (l) sensors that measure chemical properties of the wellbore fluid.

24. The method of claim 17 further comprising controlling drilling direction using a downhole controlled steering device.

25. The method of claim 17, wherein the neural network updates at least one internal model during the drilling of the wellbore based in part on the downhole computed answers and in part on one or more what-if scenarios.

* * * * *